US006247607B1

(12) United States Patent
King

(10) Patent No.: US 6,247,607 B1
(45) Date of Patent: Jun. 19, 2001

(54) LOW PROFILE SECONDARY SEAL

(75) Inventor: Richard P. King, Magnolia, TX (US)

(73) Assignee: HMT Inc., Houston, TX (US)

( * ) Notice: Subject to any disclaimer, the term of this patent is extended or adjusted under 35 U.S.C. 154(b) by 0 days.

(21) Appl. No.: 09/216,593

(22) Filed: Dec. 18, 1998

(51) Int. Cl.[7] ..... B65D 88/50

(52) U.S. Cl. ..... 220/221; 220/222; 220/224; 220/226; 277/569; 277/652; 277/936

(58) Field of Search ..... 220/216, 221, 220/222, 224, 226; 428/36.5, 36.1, 71, 422, 319.7; 277/944–946, 936, 652, 549, 569

(56) References Cited

U.S. PATENT DOCUMENTS

| | | | | |
|---|---|---|---|---|
| 2,790,574 | | 4/1957 | Consani . | |
| 3,333,725 | * | 8/1967 | Hirata et al. | 220/226 |
| 3,565,279 | * | 2/1971 | Joor, II | 220/226 |
| 3,589,549 | | 6/1971 | Heisterberg . | |
| 4,099,643 | | 7/1978 | Wardwell et al. . | |
| 4,116,358 | * | 9/1978 | Kinghorn et al. | 220/222 |
| 4,130,217 | | 12/1978 | Hills et al. . | |
| 4,191,303 | * | 3/1980 | Kinghorn, Sr. et al. | 220/226 |
| 4,287,999 | * | 9/1981 | Heisterberg | 220/222 |
| 4,308,968 | | 1/1982 | Thiltgen et al. . | |
| 4,353,478 | * | 10/1982 | Clark | 220/226 |
| 4,371,090 | * | 2/1983 | Ogarek et al. | 220/222 |
| 4,406,377 | * | 9/1983 | Bruening | 220/222 |
| 4,615,458 | * | 10/1986 | Grove et al. | 220/222 |
| 4,811,859 | * | 3/1989 | Kinghorn, Jr. | 220/224 |
| 5,078,293 | | 1/1992 | Lippiello . | |
| 5,103,992 | | 4/1992 | Lippiello et al. . | |
| 5,301,828 | | 4/1994 | McKay . | |
| 5,351,848 | * | 10/1994 | Wagoner | 220/224 |
| 5,372,270 | | 12/1994 | Rosenkrantz . | |
| 5,927,534 | * | 7/1999 | King et al. | 220/224 |

FOREIGN PATENT DOCUMENTS

| | | | | |
|---|---|---|---|---|
| 3145753 | * | 5/1983 | (DE) | 220/216 |
| 3901443 | * | 7/1990 | (DE) | 220/226 |
| 86142 | * | 11/1965 | (FR) | 220/226 |
| 2165294 | * | 4/1986 | (GB) | 220/224 |
| 2251263 | * | 7/1992 | (GB) | 220/224 |

* cited by examiner

*Primary Examiner*—Nathan J. Newhouse
(74) *Attorney, Agent, or Firm*—Hogan & Hartson, LLP.

(57) ABSTRACT

A low profile secondary seal for sealing the space between the inner wall of a tank and a roof floating on a liquid product within the tank is of relatively simple, lightweight construction and of low profile so as to maximize the possible height of the floating roof within the tank. The seal includes a plurality of resilient support plates mounted in spaced-apart relation along the edge of the floating roof at first ends thereof and extending outwardly to opposite second ends thereof which are coupled to an elongated wiper assembly. The support plates are made of resilient material such as full hard stainless steel which maintains a desired shape in resilient fashion, so as to continuously resiliently bias the wiper assembly against the inner wall of the tank. The second ends of the support plates are pivotably coupled to the wiper assembly. Angled skid plates coupled to the wiper assembly engage the inner wall of the tank to facilitate movement of the wiper assembly thereover. A vapor barrier fabric, which has a first edge coupled to the rim of the floating roof and an opposite second edge coupled to the wiper assembly, is supported in a desired position by a plurality of fabric support straps disposed between the floating roof and the wiper assembly. The wiper assembly is durably constructed of low density polyethylene foam wrapped in PTFE Teflon fabric. The vapor barrier fabric is prepunched to facilitate bolting to the wiper assembly, and the location thereof on the outside of the seal facilitates inspection and replacement thereof, and shedding of rain water due to the angled orientation thereof.

10 Claims, 8 Drawing Sheets

LOW PROFILE SECONDARY SEAL

BACKGROUND OF THE INVENTION

1. Field of the Invention

The present invention relates to seals for sealing the space between a floating roof and an inner tank wall within a storage tank for petrochemical or other liquid products.

2. History of the Prior Art

It is standard practice in the field of large storage tanks such as oil storage tanks having floating roofs to provide the floating roof with one or more seals. Such seals act to seal the space between the outer rim of the floating roof and the inner tank wall while at the same time allowing the floating roof to rise or drop as the height of the liquid product within the storage tank varies. Such seals are necessary in order to prevent harmful hydrocarbon vapors from escaping through the space between the floating roof and the inner tank wall and entering the atmosphere. For some applications, a single seal is installed on the floating roof so as to seal the space between the roof and inner tank wall. For other applications, a primary seal provides the main sealing function while a secondary seal disposed above the primary seal traps any vapors that may escape through the primary seal.

Seals for floating roofs within storage tanks can assume a variety of different configurations. Examples of the different possible configurations of floating roof seals are provided by U.S. Pat. No. 4,308,968 of Thiltgen et al., U.S. Pat. No. 5,078,293 of Lippiello, U.S. Pat. No. 5,103,992 of Lippiello et al. and U.S. Pat. No. 5,301,828 of McKay. Such patents are commonly assigned with the present application. The seals depicted by these patents assume various configurations, and typically utilize vapor barrier fabrics in conjunction with other materials. Several of the configurations utilize shoe seals which are suspended from the outer edge of the floating roof for disposition adjacent and biasing against the inner tank wall. A further example of a floating roof seal is provided by copending application Ser. No. 09/082,028 of Richard P. King et al., "Seal For Floating Roof Of Storage Tank", which application is commonly assigned with the present application.

The floating roof seals described in the above-mentioned patents and application are capable of sealing the space between the floating roof and the inner tank wall effectively. However, there is a continuing need for floating roof seals that provide other options and alternatives in terms of design, fabrication and installation. Seals of relatively simple design and low cost may present particular advantages for many installations.

In the case of secondary seals mounted above primary seals for the floating roof, it would be desirable to provide such a seal of limited height so as to extend only a relatively small distance above the floating roof. This would provide the tank with increased storage capacity by increasing the maximum height to which the floating roof can rise. Such seals should be of relatively simple construction, and the light in weight. At the same time, such seals should be made of highly durable materials so as to require a minimum of maintenance and to provide a long service life. The seals must be water tight so as to keep rain water out of the liquid product within the tank. Where a vapor barrier fabric forms a part of the seals, the fabric should be disposed for ease of inspection and replacement when necessary, and should be oriented so as to shed rainwater which might otherwise collect thereon.

BRIEF DESCRIPTION OF THE INVENTION

The foregoing and other objects and features in accordance with the invention are accomplished by providing an improved secondary seal of low profile which is simply constructed of relatively few parts which are highly durable in nature. Such seals include the use of materials which are compatible with all products normally stored in floating roof tanks. The design of the seal is such as to keep rainwater out of the liquid product and to prevent collection of rainwater on the vapor barrier fabric which forms a part of the seal. The vapor barrier fabric is disposed for easy inspection, and replacement when necessary. The seal is light in weight and provides a long service life with a minimum of maintenance.

In low profile secondary seals according to the invention, a plurality of support plates are mounted in spaced-apart relation along the outer rim of the floating roof so as to extend outwardly from first ends thereof to opposite second ends which are coupled to an elongated, continuous wiper assembly disposed at the inner tank wall. The support plates are resilient in nature, and are preferably made of material such as full hard stainless steel which has a memory such that it tends to assume and maintain a predetermined shape. As a result, the support plates resiliently bias the wiper assembly against the inner tank wall. The space between the outer rim of the floating roof and the wiper assembly is covered over and sealed by a vapor barrier fabric having a first edge coupled to the floating roof and an opposite second edge coupled to the wiper assembly. The vapor barrier fabric is supported by and is maintained in a desired orientation by a plurality of support straps mounted in spaced-apart relation along the outer rim of the floating roof between the support plates and so as to extend outwardly from first ends thereof at the floating roof to opposite second ends which coupled to the wiper assembly. Like the support plates, the support straps are preferably made of resilient material with a memory such as full hard stainless steel.

The first ends of the support plates, and the first edge of the vapor barrier fabric, are coupled to the outer rim of the floating roof by a holddown channel and bolts extending through the holddown channel and through the outer rim of the floating roof. The opposite edge of the vapor barrier fabric is clamped to the upper surface of the wiper assembly by an upper clamping angle secured to the wiper assembly by bolts extending through the wiper assembly. An opposite clamping angle is located at the underside of the wiper assembly.

In accordance with the invention, the second ends of the support plates are coupled to the wiper assembly to permit pivoting movement thereof relative to the wiper assembly. This maintains the wiper assembly in a desired orientation relative to the inner tank wall as the support plates move to different positions. The pivoting movement is provided for by portions of the bolts in the wiper assembly which extend below the wiper assembly and which are not threaded. These unthreaded portions of the bolts extend through slots in the support plates to enable pivoting movement of the wiper assembly relative to the slotted second ends of the support plates.

Movement of the wiper assembly along the inner wall of the tank is facilitated by a plurality of skid plates of angled configuration which are mounted in spaced-apart relation along the wiper assembly. Some of the skid plates are mounted on the top of the wiper assembly and extend upwardly therefrom, while still other skid plates are mounted at the underside of the wiper assembly and extend downwardly therefrom. The skid plates are coupled to the wiper assembly by the bolts extending through the wiper assembly. The skid plates are preferably made of resilient material having some memory, such as quarter hard stainless steel.

In accordance with the invention, the elongated wiper assembly is constructed so as to engage the inner tank wall in effective sealing fashion, and so as to resist wear so that maintenance thereof is minimized and the seal is provided with a long service life. The wiper assembly is comprised of a foam element which is wrapped in highly durable PTFE Teflon (Petro Flex) fabric. The foam element is a low density polyethylene foam of closed cell construction and which has a memory. The foam element has the outer surface thereof wrapped in the PTFE Teflon (Petro Flex) fabric which is very durable and which is chemically compatible with all products normally stored in the tank.

BRIEF DESCRIPTION OF THE DRAWINGS

The foregoing and other objects, features and advantages of the invention will be apparent from the following more particular description of preferred embodiments of the invention as illustrated in the accompanying drawings, in which.

DETAILED DESCRIPTION

Figure 1:
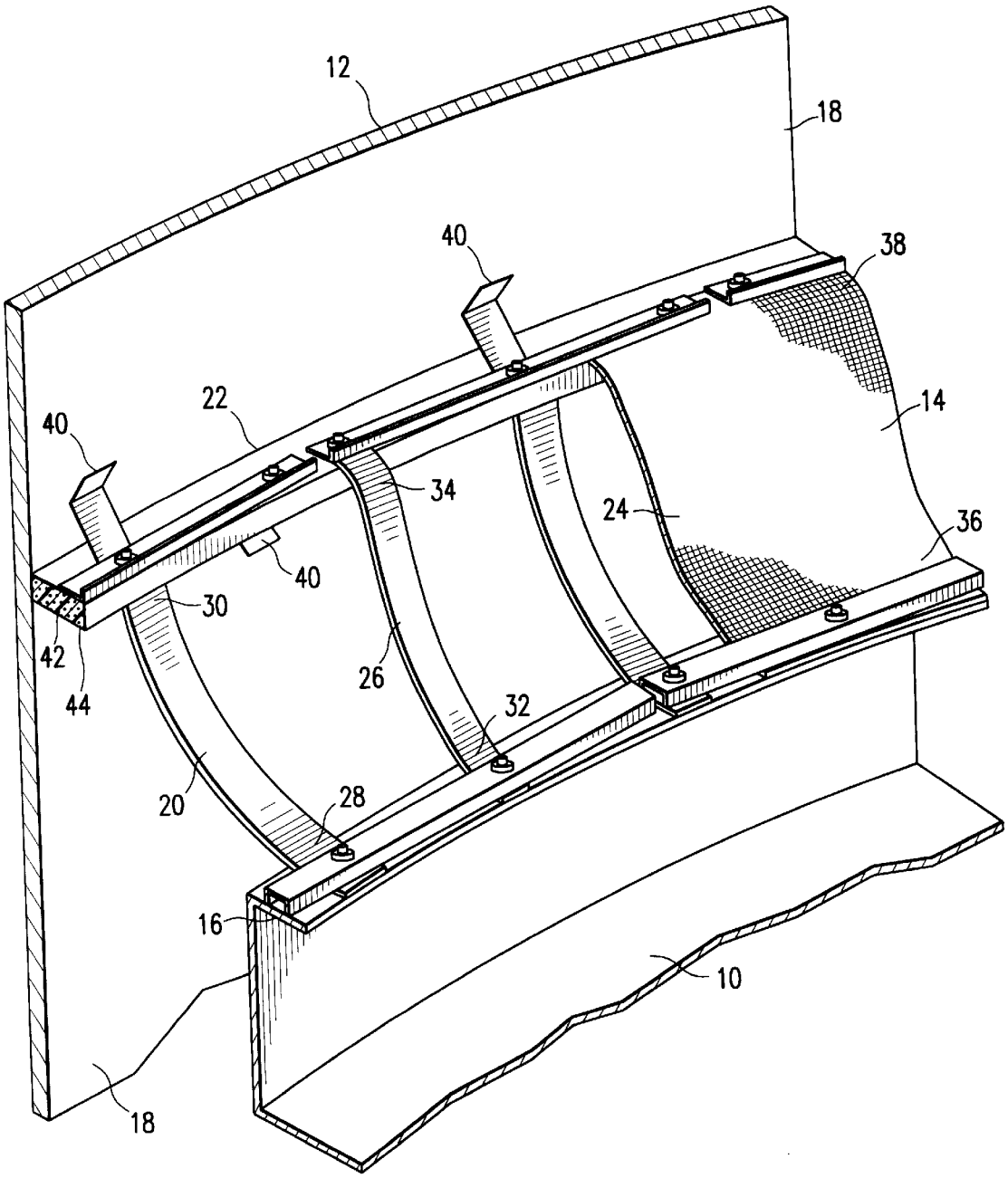
FIG. 1 is a perspective view of a portion of a storage tank together with a floating roof and having a low profile secondary seal between the outer rim of the floating roof and the inner tank wall in accordance with the invention.

FIG. 1 shows a floating roof 10 within a storage tank 12 and having a low profile secondary seal 14 in accordance with the invention. Only portions of the floating roof 10, the storage tank 12 and the secondary seal 14 are shown in FIG. 1, for simplicity of illustration. The floating roof 10 and the storage tank 12 are of conventional design. The floating roof 10, which has an outer rim 16 extending about the outer periphery of the circular configuration thereof, floats on a liquid product (not shown) within the storage tank 12. For typical petrochemical applications, the liquid product comprises oil, gasoline or other petrochemical liquid.

The secondary seal 14 is mounted on the outer rim 16 of the floating roof, and seals the space between the floating roof 10 and an inner tank wall 18 of the storage tank 12. Because the level of the liquid product within the storage tank 12 varies, the secondary seal 14 must be capable of sealing the space between the outer rim 16 of the floating roof 10 and the inner tank wall 18 as the level of the liquid product varies. A primary seal (not shown) provides the principal sealing function, with the secondary seal 14 providing additional or backup sealing of the space between the floating roof 10 and the inner tank wall 18. The primary seal can be of any conventional design which permits installation of the secondary seal 14 in the position shown in FIG. 1.

The secondary seal 14 is of relatively simple, lightweight construction, and is of limited height so as to have a low profile. This maximizes the height to which the floating roof 12 can extend, within the storage tank 12. As shown in FIG. 1, the secondary seal 14 is comprised of only a few basic components, which include support plates 20, an elongated, continuous wiper assembly 22, and a vapor barrier fabric 24. The support plates 20, which are elongated thin straps of resilient metal, are mounted on the floating roof 10 in spaced-apart relation, and extend to and support the wiper assembly 22. The wiper assembly 22 resides against and is slidable relative to the inner tank wall 18. The vapor barrier fabric 24 extends between the outer rim 16 of the floating roof 10 and the wiper assembly 22 to seal the space therebetween. A plurality of fabric support straps 26 are mounted in spaced-apart relation along the floating roof 10 to support the vapor barrier fabric 24 in a desired position. The details of the secondary seal 14 are shown in the top view of FIG. 2 and the sectional view of FIG. 3, as well as in the perspective view of FIG. 1.

The support plates 20 function to mount the wiper assembly 22 and to bias the wiper assembly 22 against the inner tank wall 18. Each of the support plates 20 has an inner or first end 28 thereof coupled to the outer rim 16, and extends from the first end 28 to an opposite outer or second end 30 which is coupled to the wiper assembly 22. As described in detail hereafter in connection with FIGS. 8 and 9, the support plates 20 are made of resilient material which has a memory. As such, the support plates 20 seek to assume a predetermined configuration. The support plates 20 flex as necessary as the floating roof 10 varies its position relative to the inner tank wall 18, while continuously providing the necessary biasing force to maintain the wiper assembly 22 in sealing contact with the inner tank wall 18. The resilient material of the support plates 20 does not fatigue with aging, and contributes to the long service life of the secondary seal 14 in accordance with the invention.

Figure 10:
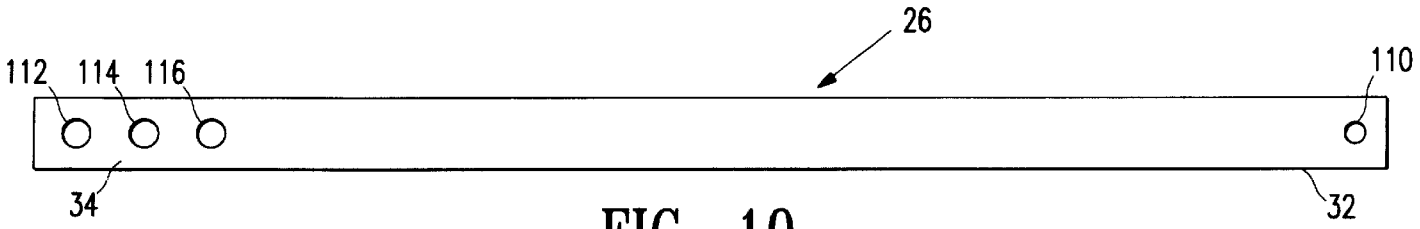
FIG. 10 is a top view of one of the fabric support straps of the arrangement of FIG. 1 when in an unfolded condition.

The fabric support straps 26, which are described in greater detail hereafter in connection with FIG. 10, are also made of resilient material which has a memory and which tends to assume a desired configuration. The fabric support straps 26 are interspersed between the support plates 20, and each has an inner or first end 32 mounted on the outer rim 16 of the floating roof so as to extend outwardly to an opposite outer or second end 34 which is coupled to the wiper assembly 22.

Only a portion of the vapor barrier fabric 24 is shown in FIG. 1 so as to illustrate the details of the secondary seal 14 beneath the vapor barrier fabric 24. The fabric 24 has a first or inner edge 36 thereof which is mounted along the outer rim 16 of the floating roof 10. An opposite second or outer edge 38 of the fabric 24 is mounted along the wiper assembly 22.

A plurality of skid plates 40 are mounted on the wiper assembly 22 so as to extend outwardly therefrom and into contact with the inner tank wall 18. The skid plates 40, which are made of resilient material, facilitate sliding movement of the wiper assembly 22 along the inner tank wall 18. As shown in FIG. 1, alternate ones of the skid plates 40 extend upwardly from an upper surface of the wiper assembly 22, while intervening ones of the skid plates 40 extend downwardly from a lower surface of wiper assembly 22. The skid plates 40 are described in greater detail hereafter in connection with FIGS. 13 and 14.

The wiper assembly 22 is comprised of a wiper 42 of foam material which is wrapped in a wiper wrap fabric 44. The foam material of the wiper 42 permits the wiper assembly 22 to conform to and maintain its sealing engagement with the inner tank wall 18 under a variety of operating conditions. The fabric 44 which is wrapped around the wiper 42 is of highly durable material which resists wear and which contributes to the long service life of the secondary seal 14. As described hereinafter in connection with FIGS. 4 and 5, the wiper assembly 22 is pivotally coupled to the outer or second ends 30 of the support plates 20. Such pivotable coupling permits the wiper assembly 22 to maintain an optimum sealing orientation against the inner tank wall 18. The wiper assembly 22 is described in greater detail hereafter in connection with FIGS. 15 and 16.

Figure 2:
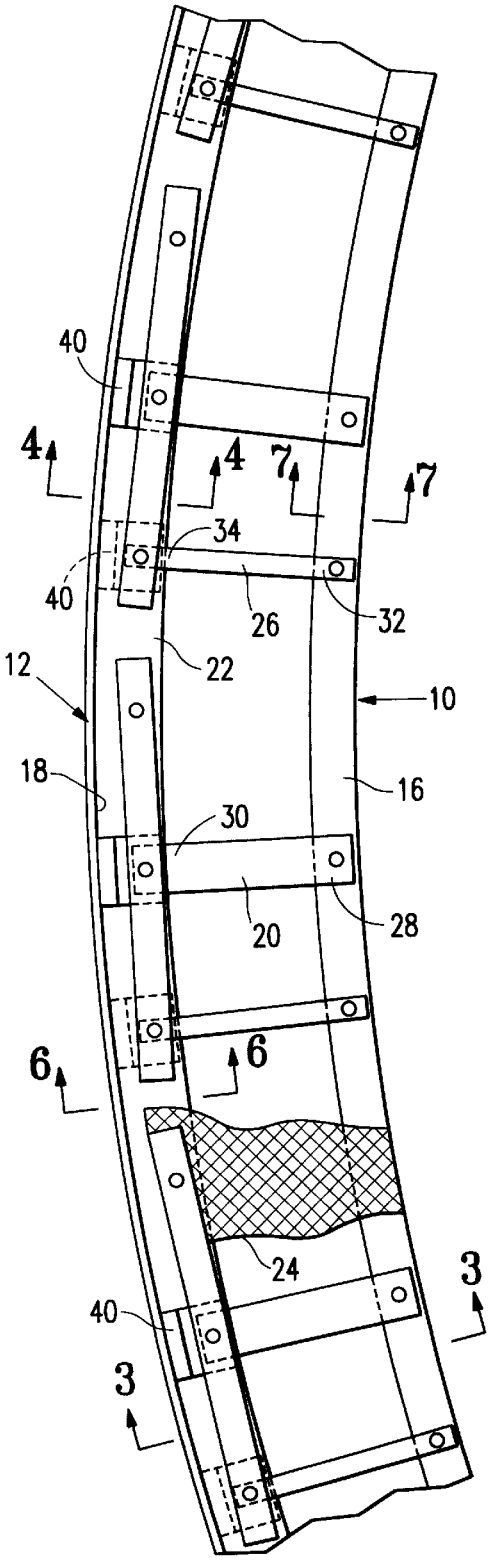
FIG. 2 is a top view of the arrangement of FIG. 1.
Figure 4:
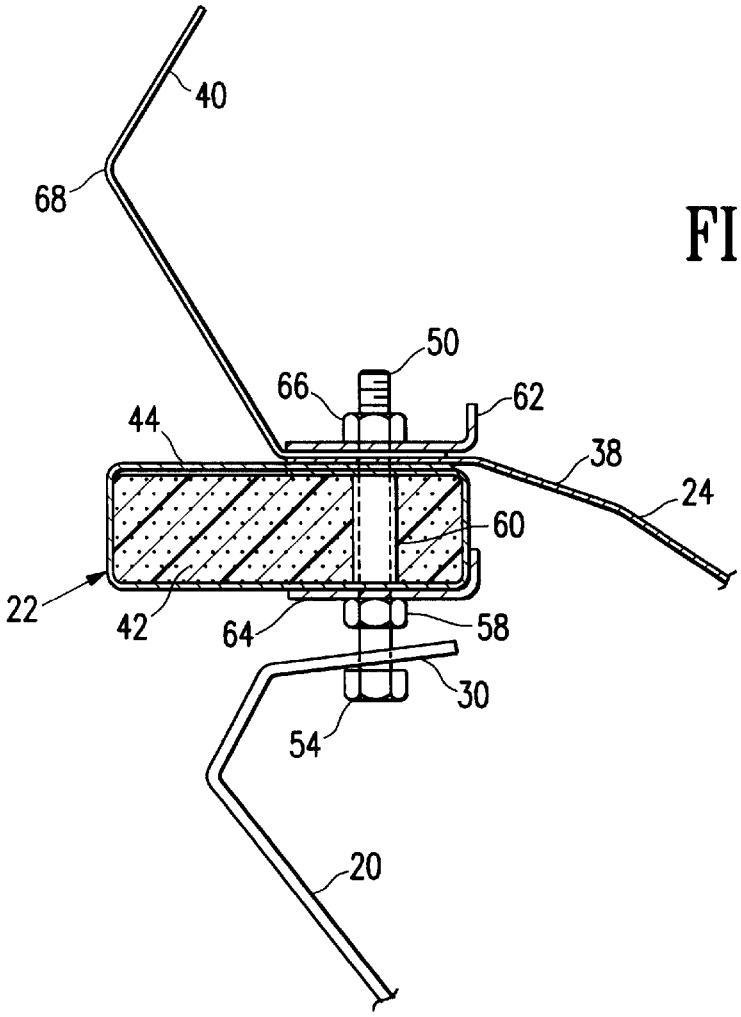
FIG. 4 is a sectional view of the arrangement of FIG. 2 taken along the line 4—4 thereof.
Figure 5:
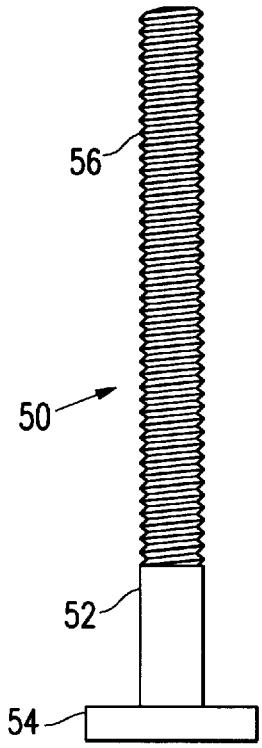
FIG. 5 is a perspective view of the bolt shown in FIG. 4.

FIG. 4, which is a sectional view taken along the line 4—4 of FIG. 2, shows the details of the manner in which the outer or second ends 30 of the support plates 20 are coupled to the wiper assembly 22. As shown in FIG. 4, the wiper assembly 22 is comprised of the foam wiper 42 which is generally rectangular in cross section and which has the outer surface thereof wrapped in the fabric 44. Each of the plates 20 is coupled to the wiper assembly 22 by a bolt 50 which extends through the wiper assembly 22. As shown in FIG. 5, the bolt 50 is of special configuration, inasmuch as it has a non-threaded shaft portion 52 extending from a head 54 to a threaded shaft portion 56. After inserting the bolt 50 through a slot in the second end 30 of the support plate 20, a nut 58 is advanced along the threaded shaft portion 56 to a desired position adjacent the end thereof. The bolt 50 is installed within the wiper assembly 22 with the nut 58 in this position, permitting the second end 30 of the support plate 20 to slide up and down along the non-threaded shaft portion 52 between the head 54 and the nut 58. This play or freedom permits the pivoting movement of the wiper assembly 22 relative to the second ends 30 of the support plates 20 that enables the wiper assembly 22 to assume a desired sealing orientation relative to the inner tank wall 18, as the support plates 20 flex and move.

With the nut 58 mounted on the threaded shaft portion 56 of the bolt 50, as shown in FIG. 5, the bolt 50 is installed in the wiper assembly 22 as shown in FIG. 4. A hollow, cylindrical bolt sleeve 60 is installed in an aperture within the wiper assembly 22 so as to extend between an opposite pair of wiper clamping angles 62 and 64 disposed on an upper surface and a lower surface of the wiper assembly 22, respectively. The nut 58 resides against the lower clamping angle 64. At the upper surface of the wiper assembly 22, the bolt 50 extends through the outer edge 38 of the vapor barrier fabric 24 and then through an adjacent portion of the wiper wrapped fabric 44, before passing through the upper clamping angle 62. A nut 66 is then installed on the exposed threaded shaft portion 56 of the bolt 50. The bolt sleeve 60 prevents undue compression of the resilient wiper assembly 22 as the nut 66 is installed on the bolt 50. Before passing through the upper clamping angle 62, the bolt 50 passes through an aperture in one of the skid plates 40. As shown in FIG. 4, the particular skid plate 40 extends in an upward direction from the upper surface of the wiper assembly 22 and into contact with the inner tank wall 18 at a bend 68 therein.

Figure 12:
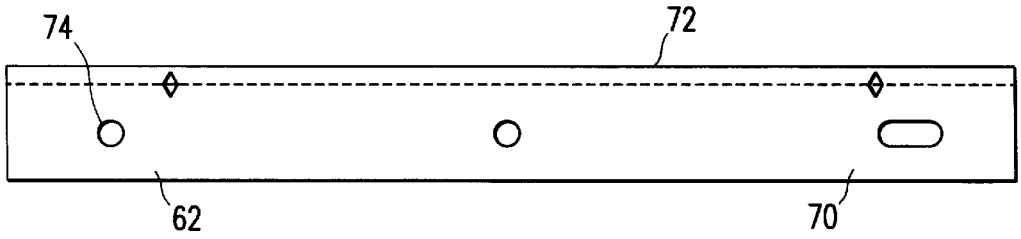
FIG. 12 is a top view of one of the holddown angles of the arrangement of FIG. 1.

The upper and lower wiper clamping angles 62 and 64 are of like configuration. One of the upper clamping angles 62 is shown in FIG. 12. The angle 62 has a flat planar lower portion 70 which curves upwardly to form a sidewall 72 along a side edge of the flat, planar lower portion 70. The flat, planar lower portion 70 has apertures 74 spaced along the length thereof for receiving bolts such as the bolt 50 shown in FIGS. 4 and 5. Because the wiper assembly 22 is curved, a plurality of the clamping angles 62 and the opposite clamping angles 64 are positioned end-to-end along the wiper assembly 22.

Figure 6:
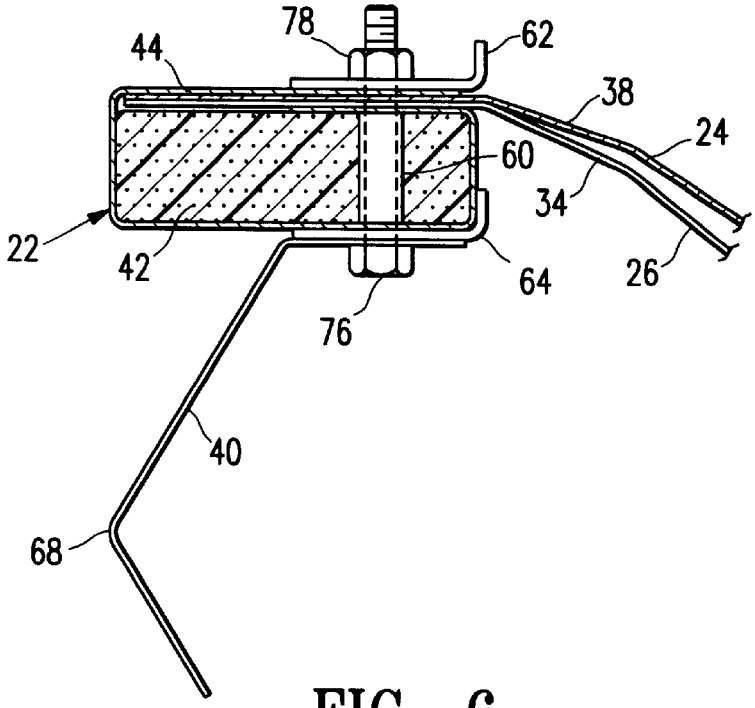
FIG. 6 is a sectional view of the arrangement of FIG. 2 taken along the line 6—6 thereof.

FIG. 6, which is a sectional view taken along the line 6—6 of FIG. 2, shows the details of the coupling of the second end 34 of the fabric support strap 26 to the wiper assembly 22. As in the case of FIG. 4, a bolt sleeve 60 is installed in an aperture in the wiper assembly 22. A conventional bolt 76 is inserted through a hole in a lower-extending one of the skid plates 40, and then through the lower clamping angle 64 and into the bolt sleeve 60. At the upper surface of the wiper assembly, the bolt 76 extends through an aperture in the second end 34 of the fabric support strap 26, then through the outer edge 38 of the vapor barrier fabric 24 before extending through the upper clamping angle 62. A nut 78 is then installed on the threaded portion of the bolt 76. In contrast to the skid plate 40 shown in FIG. 4, the skid plate 40 of FIG. 6 extends downwardly from the lower surface of the wiper assembly 22 to a bend 68 where the skid plate 40 engages the inner tank wall 18.

Figure 7:
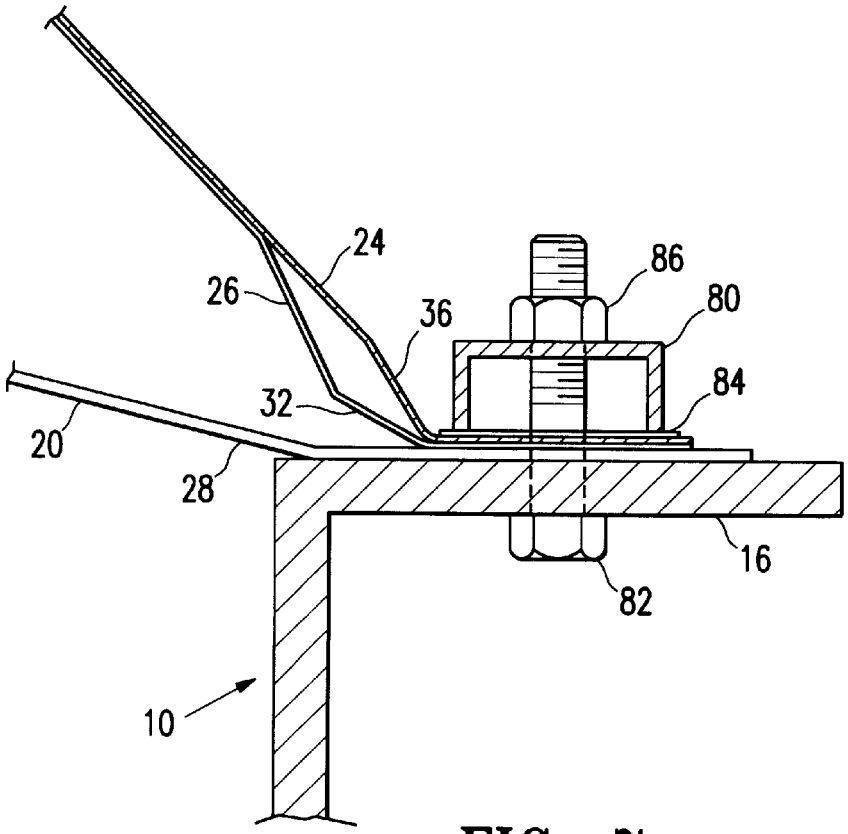
FIG. 7 is a sectional view of the arrangement of FIG. 2 taken along the line 7—7 thereof.

FIG. 7 is a sectional view taken along the line 7—7 of FIG. 2 and showing the manner in which the support plates 20, the fabric support straps 26 and the vapor barrier fabric 24 are mounted on the outer rim 16 of the floating roof 10. A holddown channel 80 of generally U-shaped cross-sectional configuration holds the support plate 20, the fabric support strap 26 and the vapor barrier fabric 24 against an upper surface of the outer rim 16. A bolt 82 extends upwardly through an aperture in the outer rim 16 before extending through an aperture in the first end 28 of the support plate 20. The bolt 82 then extends through an aperture in the first end 32 of the fabric support strap 26, and then through the inner edge 36 of the vapor barrier fabric 24. A length of neosponge tape 84 is placed over the inner edge 36 of the vapor barrier fabric 24 before installation of the holddown channel 80 to enhance the sealing action. The bolt 82 extends upwardly through an aperture in the holddown channel 80 and receives a nut 84 at an upper threaded end thereof.

Figure 8:
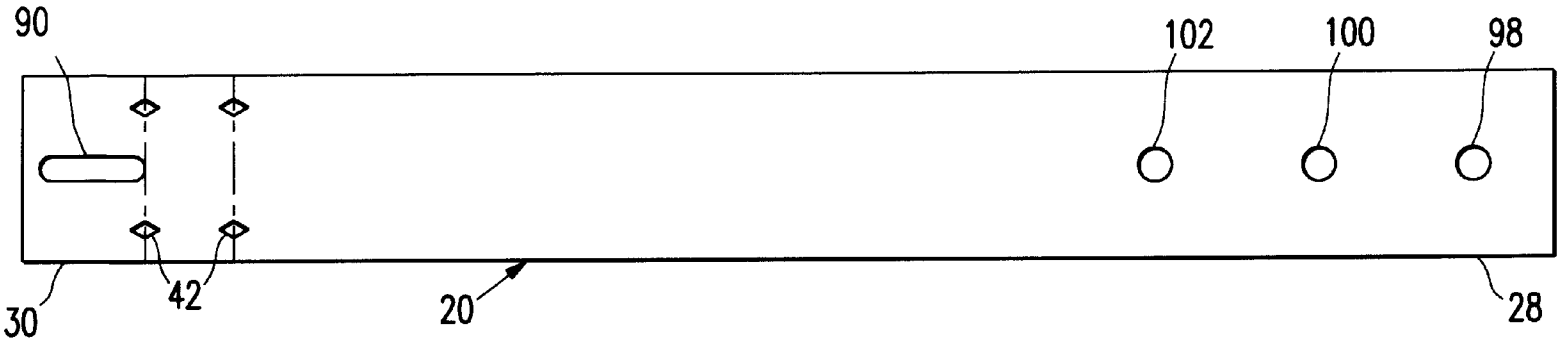
FIG. 8 is a top view of one of the support plates of the arrangement of FIG. 1 in an unfolded condition.
Figure 9:
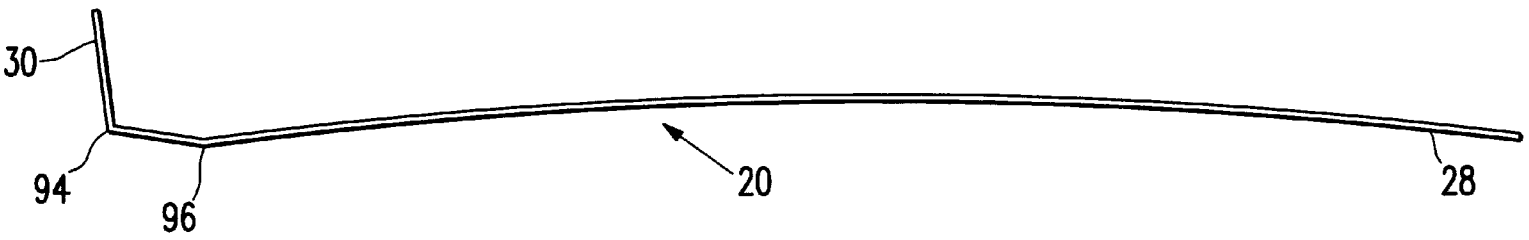
FIG. 9 is a side edge view of the support plate of FIG. 8 showing a desired shape which it assumes after being folded.

One of the support plates 20 is shown in detail in FIGS. 8 and 9. FIG. 8 is a top view of the support plate 20 as formed and prior to bending of the plate. The support plate has an elongated slot 90 therein adjacent the second end 30 thereof. The support plate 20 is also provided with apertures therein to facilitate bending thereof at desired locations. The apertures include spaced-apart pairs of diamond-shaped apertures 92 adjacent the slot 90 and spaced along a pair of axes extending across the width of the support plate 20. During formation of the support plate 20, the plate 20 is bent along such axes so as to form bends 94 and 96, as shown in FIG. 9. The support plate 20 is formed so as to assume the slightly curved configuration shown in FIG. 9 when in an unflexed condition. The support plate 20 is made of resilient material with a memory, such that it continually seeks to assume the configuration shown in FIG. 9.

The inner or first end 28 of the support plate 20 is provided with a plurality of spaced-apart apertures. A first such aperture 98 receives the bolt 82 shown in FIG. 7 to mount the first end 28 on the outer rim 16 of the floating roof 10. An adjacent pair of apertures 100 and 102 cause the support plate 20 to flex and form bends 104 and 106 shown in FIG. 3 when the support plate 20 is installed on the outer rim 16 and resiliently supports the wiper assembly 22.

As noted above, the support plate 20 is made of resilient material with a memory such that, when formed into the desired shape as shown in FIG. 9, it thereafter retains such shape in resilient fashion. An example of a suitable material is full hard stainless steel of the type manufactured by Precision Steel Warehouse, Inc.

FIG. 10 is a top view of one of the fabric support straps 26. As shown in FIG. 10, the fabric support strap 26 has an aperture 110 at the inner or first end 32 thereof to receive the bolt 82 when mounting the fabric support strap 26 on the outer rim 16 of the floating roof 10 in the manner shown in FIG. 7. The outer or second end 34 of the fabric support strap 26 is provided with a plurality of spaced-apart apertures. A first such aperture 112 receives the bolt 76 when the second end 34 is coupled to the wiper assembly 22 as shown in FIG. 6. An adjacent pair of apertures 114 and 116 facilitate bending of the outer or second end 34 of the fabric support strap 26 in the manner shown in FIG. 6. Like the support plate 20, the fabric support strap 26 is made of resilient material with a memory, and is preferably made of full hard stainless steel.

Figure 11:
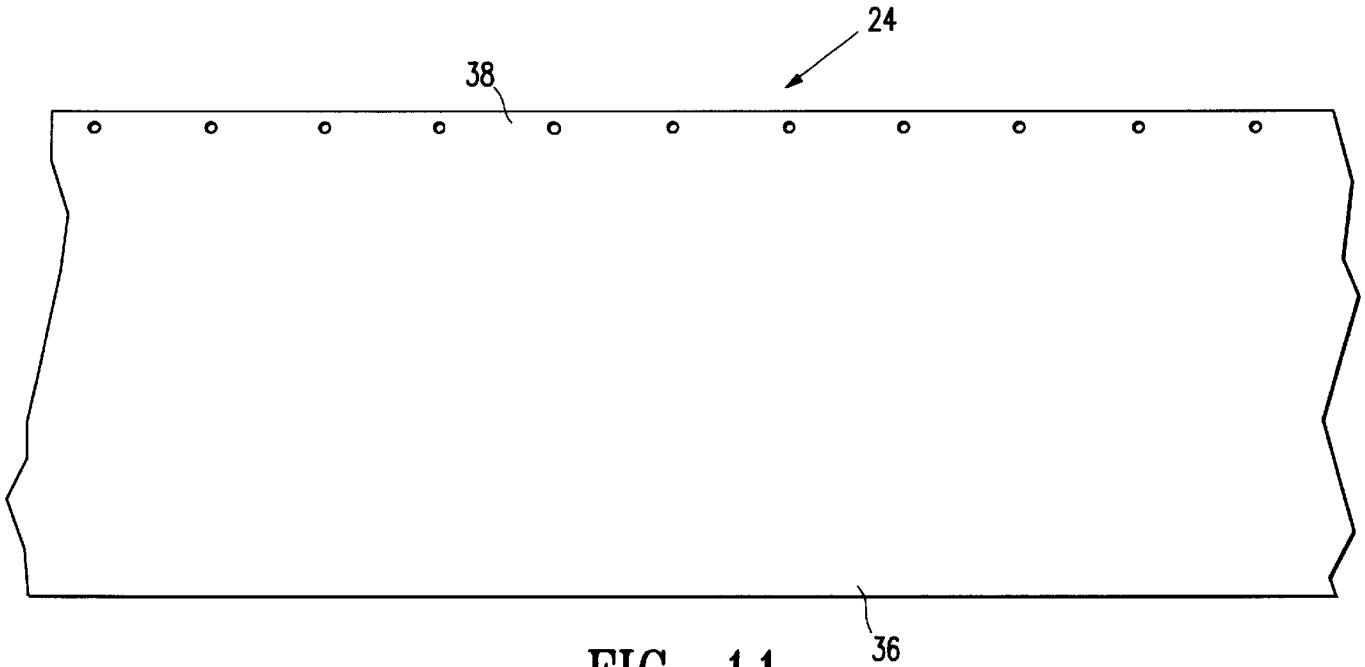
FIG. 11 is a top view of the vapor barrier fabric of the arrangement of FIG. 1.

As best shown in FIG. 1, the vapor barrier fabric 24 is exposed at the outside of the secondary seal 14. Additionally, the fabric 24 is held in a desired sloped configuration by the fabric support straps 26 to promote shedding of rain water which might otherwise accumulate on and accelerate the deterioration of the vapor barrier fabric 24. Exposure of the vapor barrier fabric 24 at the outside of the secondary seal 14 facilitates visual inspection of the vapor barrier fabric 24. Additionally, exposure of the vapor barrier fabric 24 facilitates the replacement thereof, if it becomes necessary to do so. Installation of the vapor barrier fabric 24, either initially or as a replacement item, is facilitated by preforming the fabric 24 with a plurality of spaced-apart apertures adjacent the outer edge 38, as shown in FIG. 11. The apertures are spaced so as to receive the bolts 50 and 76 upon mounting of the outer edge 38 of the fabric 24 on the wiper assembly 22, as shown in FIGS. 4 and 6. The inner edge 36 of the fabric 24 is mounted on the outer rim 16 of the floating roof 10 by placement down over the bolts 82. With the inner edge 36 so disposed, a length of the neosponge tape 84 is placed thereover, the holddown channel 80 is installed in place, and the nuts 86 are advanced onto the bolts 82.

Figure 13:
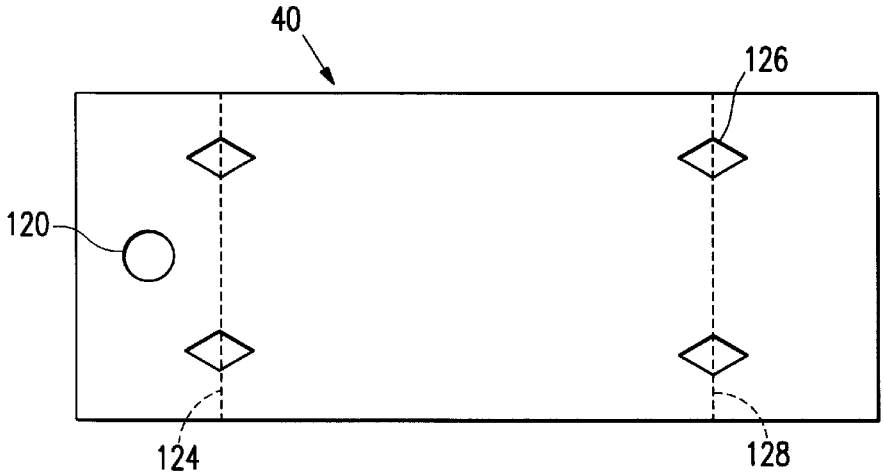
FIG. 13 is a top view of one of the skid plates of the arrangement of FIG. 1 when in an unfolded condition.
Figure 14:
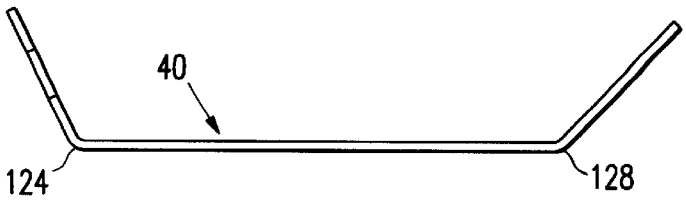
FIG. 14 is a side edge view of the skid plate of FIG. 13 after being folded into a desired configuration.

FIG. 13 shows the skid plate 40 during the formation thereof and prior to bending. The skid plate 40 is provided with an aperture 120 adjacent an end thereof, for receiving the bolt 50 when installed on the upper surface of the wiper assembly 22 as shown in FIG. 4 and for receiving the bolt 76 when installed at the lower side of the wiper assembly 22 as shown in FIG. 6. An adjacent pair of diamond-shaped apertures facilitate bending so as to form a bend 124 upon formation of the skid plate 40, as shown in FIG. 14. A pair of spaced-apart diamond-shaped apertures 126 adjacent an opposite end of the skid plate 40 facilitate formation of a second bend 128 therein. When formed, the skid plate 40 assumes the shape shown in FIG. 14. The skid plate 40 is made of resilient material which has at least some memory which causes it to return to the desired configuration shown in FIG. 14. Preferably, the skid plate 40 is made of a material such as quarter hard stainless steel.

Figure 3:
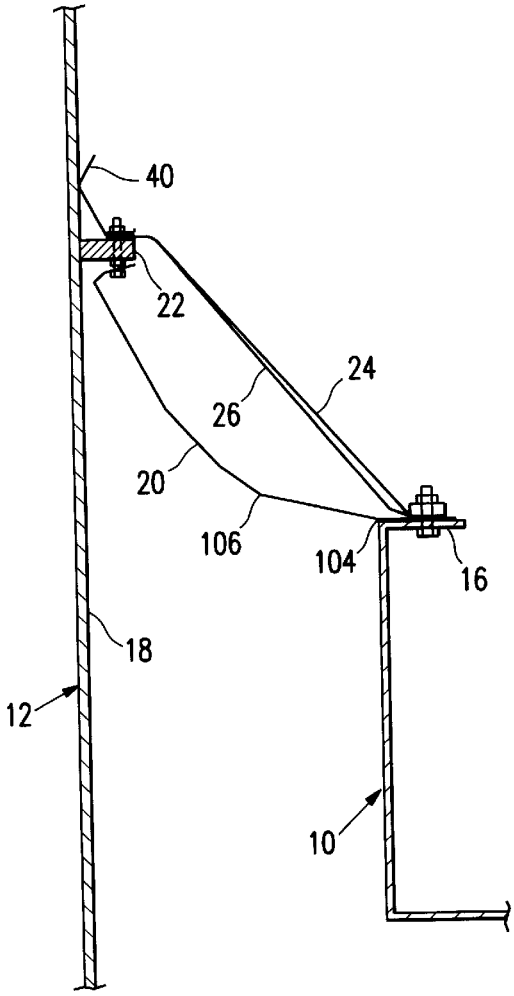
FIG. 3 is a sectional view of the arrangement of FIG. 2 taken along the line 3—3 thereof.
Figure 15:
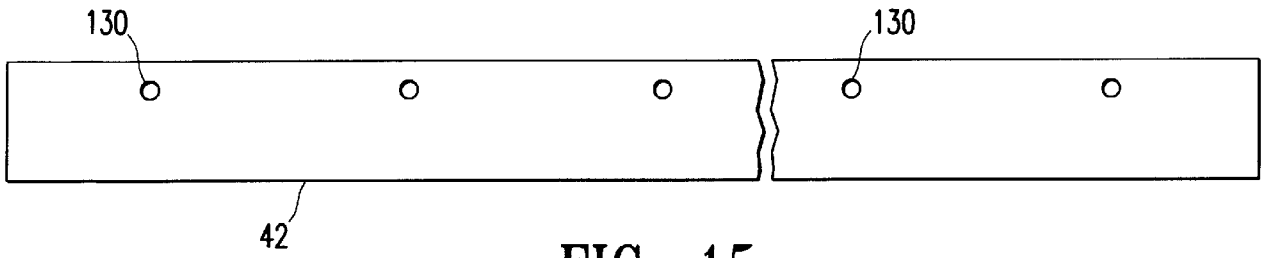
FIG. 15 is a top view of a foam element of the wiper assembly of the arrangement of FIG. 1.

FIG. 15 is a top view of the foam element which forms the wiper 42. As shown in FIGS. 3, 4 and 6, the foam element has a uniform, generally rectangular cross-sectional configuration. The foam element of the wiper 42 is able to conform to the inner tank wall 18 in resilient fashion, and at the same time with enough memory so as to remain usable over the relatively long life of the secondary seal 14. Preferably, the foam element of the wiper 42 is made of a closed cell foam having a low density, such as a polyethylene foam with memory. As shown in FIG. 15, the foam element of the wiper 42 is formed with a plurality of spaced-apart apertures 130 therein for receiving the bolts 50 and 76 as shown in FIGS. 4 and 6.

Figure 16:
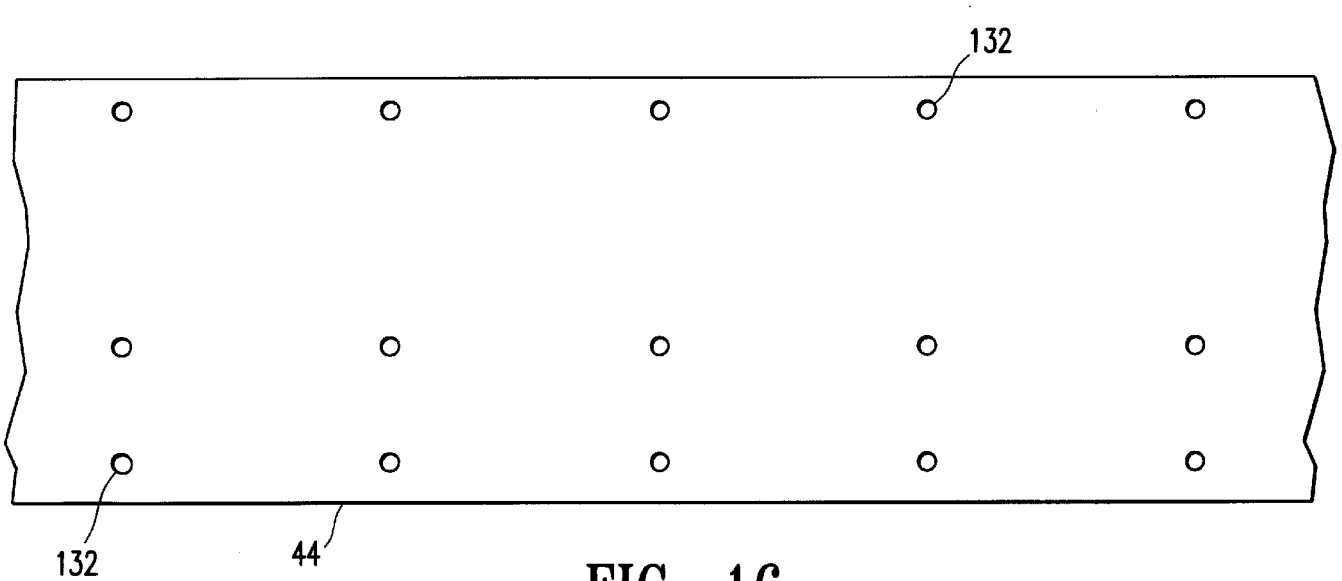
FIG. 16 is a top view of the wiper wrap fabric before being wrapped around the foam element of FIG. 15 to form the wiper assembly.

To protect the outer surface of the foam element of the wiper 42 from wear, the wiper 42 is wrapped with the wiper wrap fabric 44. A length of the fabric 44 is shown in FIG. 16. As shown therein, the fabric 44 is provided with three rows of apertures 132 along the length thereof. This enables the fabric 44 to be completely wrapped around the outer surface of the wiper 42, with the rows of apertures 132 then being positioned to receive the bolts 50 and 76 at the upper and lower surfaces of the wiper assembly 22. The wiper wrap fabric 44 is made of highly durable material which resists abrasion and deterioration during repeated movement thereof over the inner tank wall 18. At the same time, the fabric 44 should be chemically compatible with all liquid products used in the storage tank 12. A material which has been found suitable for use as the wiper wrap fabric 44 is PTFE Teflon (Petro Flex) fabric. Such fabric has the abrasion resistance necessary to provide the secondary seal 14 with long life, and is chemically compatible with the liquid products typically stored in the storage tank 12. "Teflon" is a trademark identifying polytetrafluorethylene. A suitable Teflon fabric for use as the wiper wrap fabric 44 is a PTFE Teflon cloth sold by Bron Tapes of Colorado, Inc.

While the invention has been particularly shown and described with reference to preferred embodiments, it will be understood by those skilled in the art that the foregoing and other changes in form and details may be made therein without departing from the spirit and scope of the invention.

What is claimed is:

1. For use in a tank for storing a liquid product and having a roof floating on the liquid product, an arrangement for sealing a space between the floating roof and an inner wall of the tank, comprising the combination of:

an elongated wiper assembly for sealing disposition against the wall of a tank;

a plurality of elongated support plates for mounting in spaced-apart relation along the floating roof and extending outwardly therefrom and coupled to the elongated wiper assembly, the support plates resiliently biasing the elongated wiper assembly against the wall of the tank;

a vapor barrier fabric extending between and having a first edge for coupling to the floating roof and an opposite second edge coupled to the elongated wiper assembly; and a plurality of elongated fabric support straps for mounting in spaced-apart relation along the floating roof and extending outwardly therefrom and coupled to the elongated wiper assembly and supporting the vapor barrier fabric.

2. The arrangement in accordance with claim 1, wherein the plurality of elongated fabric support straps are made of resilient material which maintains the shape in resilient fashion.

3. The arrangement in accordance with claim 2, wherein the plurality of elongated fabric support straps are made of full hard stainless steel.

4. A storage tank arrangement comprising the combination of:

a generally cylindrical tank having an inner wall;

a generally circular roof for floatation on a liquid product in the tank and having an outer rim;

a plurality of elongated support plates mounted along the outer rim of the roof in spaced-apart fashion at first ends thereof and extending outwardly from the outer rim to opposite seconds ends thereof;

an elongated wiper assembly mounted on the second ends of the support plates and disposed at the wall of the tank;

a vapor barrier fabric disposed above the elongated support plates and having a first edge mounted along the outer rim of the roof and an opposite second edge coupled to the wiper assembly along the length thereof;

wherein the support plates resiliently bias the elongated wiper assembly against the inner wall of the tank and are made of resilient material which maintains a predetermined shape in resilient fashion; and a plurality of resilient fabric support straps mounted along the outer rim of the roof in spaced-apart fashion at first ends thereof and extending outwardly from the outer rim to opposite second ends thereof coupled to the elongated wiper assembly, the resilient fabric support straps supporting the vapor barrier fabric in in its position in resilient fashion.

5. The storage tank arrangement in accordance with claim 4, wherein the elongated support plates and the plurality of resilient fabric support straps are made of full hard stainless steel.

6. A storage tank arrangement comprising the combination of:

a generally cylindrical tank having an inner wall;

a generally circular roof for floatation on a liquid product in the tank and having an outer rim;

a plurality of elongated support plates mounted on the outer rim of the roof in spaced-apart fashion at first ends thereof and extending outwardly from the outer rim to opposite second ends thereof;

an elongated wiper assembly mounted on the second ends of the support plates and disposed at the wall of the tank; and a vapor barrier fabric disposed above the elongated support plates and having a first edge mounted along the outer rim of the roof and an opposite second edge coupled to the wiper assembly along the length thereof;

wherein the support plates resiliently bias the elongated wiper assembly against the inner wall of the tank and are made of resilient material which maintains their shape in resilient fashion; and wherein the elongated wiper assembly is mounted on the second ends of the support plates by a plurality of bolts in the wiper assembly and having shaft portions thereof extending from the wiper assembly and slidably received within apertures in the support plates to permit pivoting movement of the wiper assembly relative to the second ends of the elongated support plates.

7. The storage tank arrangement in accordance with claim 6, wherein each of the plurality of bolts has an unthreaded portion extending along a portion of a length thereof from a head thereof for slidably receiving the second end of one of the elongated support plates and a threaded portion for receiving a pair of nuts to clamp and mount the elongated wiper assembly therebetween.

8. The storage tank arrangement in accordance with claim 7, further including a hollow, cylindrical bolt sleeve mounted on the threaded portion of the bolt and extending through the elongated wiper assembly between the pair of nuts.

9. The storage tank arrangement in accordance with claim 7, further including opposite clamping angles disposed between the pair of nuts and opposite sides of the elongated wiper assembly.

10. The storage tank arrangement in accordance with claim 9, wherein one of the opposite clamping angles clamps the second edge of the vapor barrier fabric on the elongated wiper assembly to mount the second edge thereon.

* * * * *